US009303637B2

(12) United States Patent
Pattakos et al.

(10) Patent No.: US 9,303,637 B2
(45) Date of Patent: Apr. 5, 2016

(54) CONNECTING ROD VALVE

(71) Applicants: Manousos Pattakos, Nikea Piraeus (GR); Efthimios Pattakos, Nikea Piraeus (GR); Paraskevi Pattakou, Nikea Piraeus (GR); Emmanouel Pattakos, Nikea Piraeus (GR)

(72) Inventors: Manousos Pattakos, Nikea Piraeus (GR); Efthimios Pattakos, Nikea Piraeus (GR); Paraskevi Pattakou, Nikea Piraeus (GR); Emmanouel Pattakos, Nikea Piraeus (GR)

( * ) Notice: Subject to any disclaimer, the term of this patent is extended or adjusted under 35 U.S.C. 154(b) by 140 days.

(21) Appl. No.: 14/176,148

(22) Filed: Feb. 10, 2014

(65) Prior Publication Data

US 2014/0234146 A1 Aug. 21, 2014

(30) Foreign Application Priority Data

Feb. 18, 2013 (GB) ..... 1302741.2
Mar. 8, 2013 (GB) ..... 1304191.8

(51) Int. Cl.
*F04B 7/04* (2006.01)
*F04B 39/00* (2006.01)

(52) U.S. Cl.
CPC ..... *F04B 39/0022* (2013.01); *F04B 39/0016* (2013.01)

(58) Field of Classification Search
CPC ..... F04B 39/0022; F04B 39/0016
See application file for complete search history.

(56) References Cited

U.S. PATENT DOCUMENTS 7,909,012 B2 * 3/2011 Pattakos ..... F01B 9/02 123/197.4

FOREIGN PATENT DOCUMENTS

GR 2515369 A * 12/2014 ..... F04B 39/0016

* cited by examiner

*Primary Examiner* — Kristen Matter

(57) ABSTRACT

A valve integral with, or secured to, the connecting rod small end of a reciprocating piston positive displacement machine opens and closes a port controlling the communication of two spaces, for gas pumps, scavenging pumps, compressors, superchargers, pumps etc.

8 Claims, 22 Drawing Sheets

37A 37B 38A 38B 39A 39B 40A 40B

CONNECTING ROD VALVE

FIELD OF THE INVENTION

The U.S. Pat. No. 7,909,012, GB2,449,031 and GB2,482,750 disclose two-stroke engines having reciprocating piston scavenging pumps. Reed, or one way, valves control the flow of the gas towards the scavenging pump and towards the combustion chamber. The connecting rod valve of the present invention can replace the reed valves, as well as the rotary valves, the poppet valves and the piston valves in the two stroke engines, in the compressors, in the pumps etc.

BACKGROUND ART

The combination of ports made on the piston skirt with ports made on the cylinder liner is a common practice; the poor scavenging efficiency and the increased pumping loss are among the disadvantages, as well as the symmetric timing: if a port is open at 80 deg before the TDC (Top Dead Center), it will also be open at 80 deg after the TDC.

The use of a one way, or reed, valve is another common solution. The inertia of the reed valve, the impact loads on the reed valve leaves, the noise, the need for a pressure difference at the two side of the reed valve, the limited reliability etc are among the disadvantages.

The use of poppet valves is another way, but they need space, cams, springs, synchronization gearing etc, while they have low flow capacity and low rev limit.

The use of a disk valve (or drum valve) formed on the crankshaft is another way; ports on the disk valve cooperate with stationary ports on the casing. The dead volume of the crankcase is unavoidably large (the volume inside the piston is added to the crankcase volume). The location of the wrist pin makes the cooling of the backside of the piston crown difficult. Each piston needs its own crankcase, etc.

It is an object of the present invention to address the above disadvantages. Accordingly, there is provided a "connecting rod valve" for reciprocating piston engines and pumps as defined in the appended claims.

SUMMARY OF THE INVENTION

This invention is for a positive displacement machine comprising at least:

a crankcase 1;

a crankshaft 2 rotatably mounted on the crankcase 1, the crankshaft 2 is comprising a crank pin 3;

a cylinder 4;

a piston 5 slidably fitted in the cylinder 4;

a connecting rod 6 rotatably mounted at a first end 7 on said crankpin 3 and pivotally mounted, at a second end 8, on said piston 5 by a wrist pin 9 so that the rotation of the crankshaft 2 causes the reciprocation of the piston 5 inside the cylinder 4, a valve 10, the valve 10 is integral with, or secured to, the connecting rod 6 at the second end side of the connecting rod, a port 11, the port 11 is disposed between two spaces 12 and 13, the working gas flows through the port 11 from the one space to the other space under the action of the piston 5, the valve 10 opens and closes the port 11 in synchronization to the crankshaft 2.

In brief: a valve 10 is secured on the wrist pin side 8 of the connecting rod 6 so that the valve 10, together with the connecting rod 6, reciprocates with the piston 5 and swings, relative to the piston 5, about the wrist pin 9; a port 11 sealingly fits with the valve 10. The valve 10 opens and closes the port 11 allowing or stopping the communication of the spaces at the two sides of the port 11.

The geometry/shape of the valve and of the port defines the timing of the port opening and closing.

Among the advantages of the connecting rod valve is the simplicity, the high flow capacity, the reliability, the high revving, the quiet operation, the smaller dead volume, the fact that it adds no additional moving parts to the basic mechanism, the asymmetric timing etc. Regarding the asymmetric timing: with the valve moving together with the connecting rod, the port opens and closes asymmetrically relative to the TDC. For instance, the port can be fully open at 90 degrees before the TDC and fully closed at 90 degrees after the TDC.

BRIEF DESCRIPTION OF THE DRAWINGS

FIG. 23 shows a modification wherein the same connecting rod drives a pair of valves: the valve area doubles, the forces—due to the pressure difference—on the two valves counterbalance each-other.

DETAILED DESCRIPTION OF THE PREFERRED EMBODIMENTS

Figure 1:
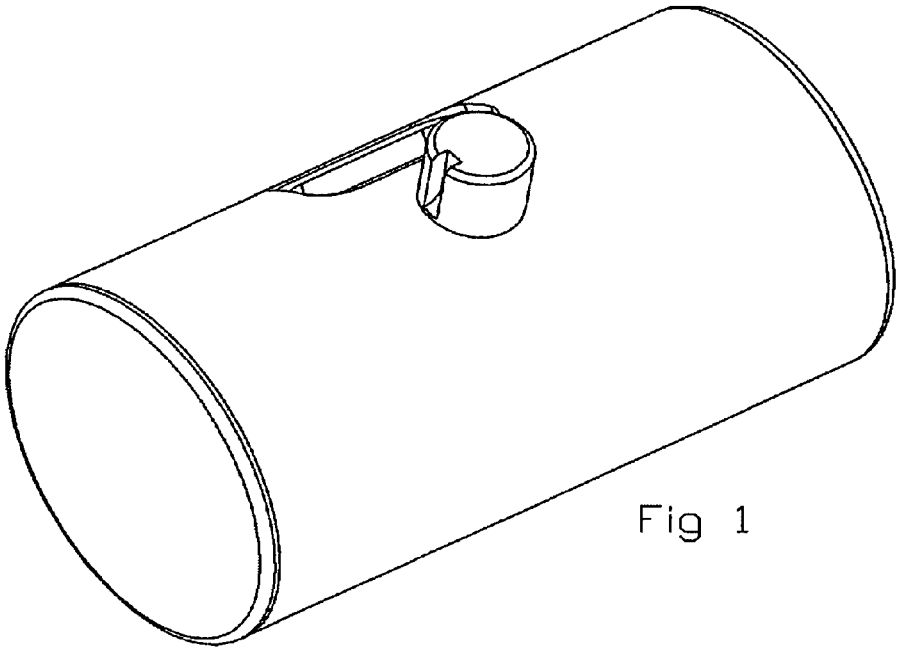
FIG. 1 shows a first embodiment. The one end of the crankshaft is shown. Air or mixture enters into the crankcase through the port on the casing (shown behind the crankshaft).
Figure 2:
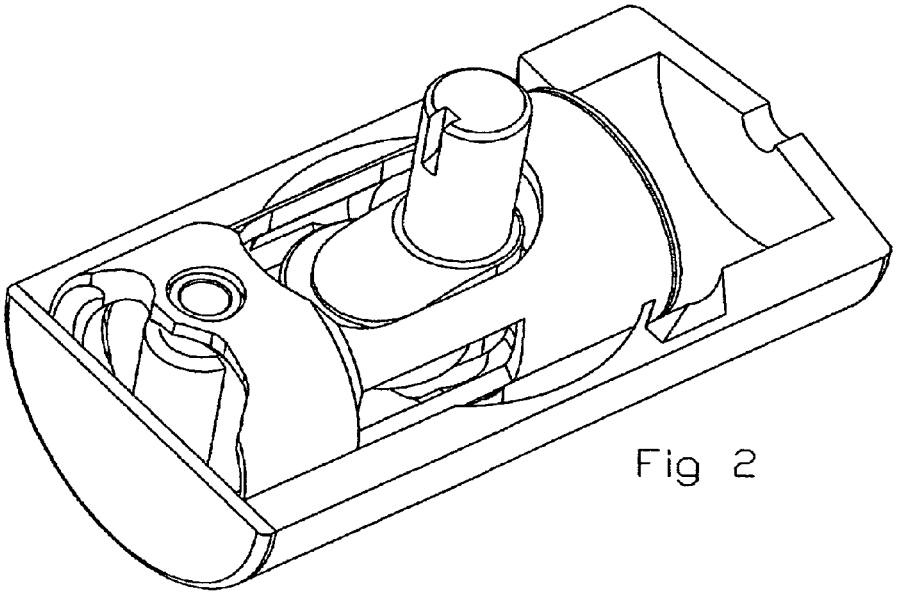
FIG. 2 shows the first embodiment with the cylinder/crankcase sliced. The engine is a pulling rod engine (U.S. Pat. No. 7,909,012, GB2,449,031) wherein the combustion causes tension loading on the connecting rod. The crankshaft extends through an opening of the piston, with the wrist pin being at the one side of the crankshaft and the combustion chamber being at the opposite side of the crankshaft. The combustion chamber is shown at right. The piston is at the BDC (Bottom Dead Center). The hole shown at right is for a spark plug, a glow plug, a fuel injector etc. The wrist pin side of the piston serves as the scavenging pump.
Figure 3:
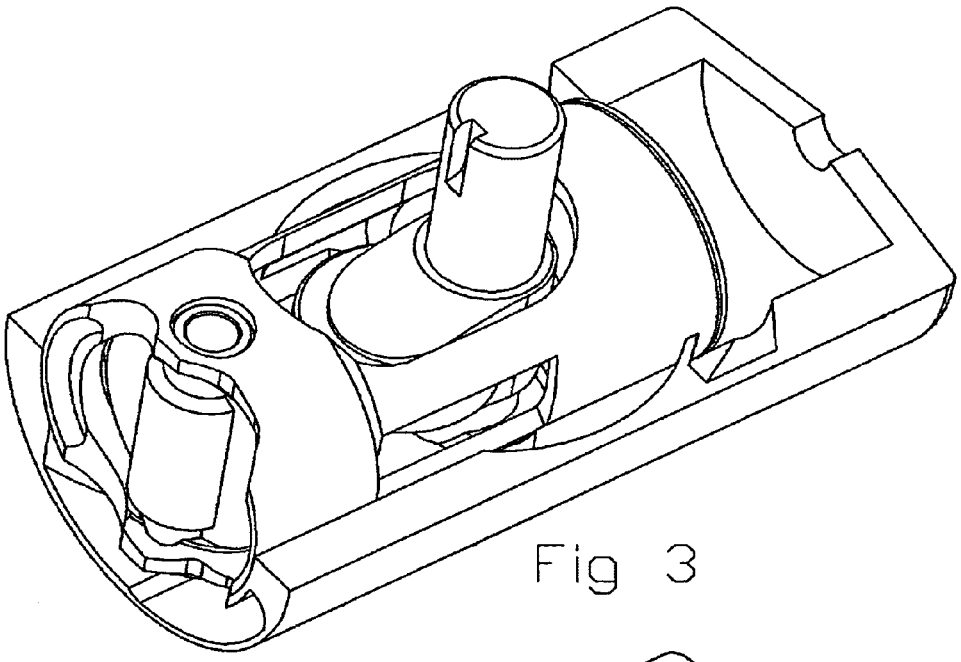
FIG. 3 shows what FIG. 2 with the bottom cover (at left) removed. At the left end of the cylinder it is shown the one end of the transfer "pipe" (cut into the casing) that connects the scavenging pump with the transfer port shown at right bottom. The exhaust port is shown at right top and is partly hidden by the crankshaft. The crankcase, i.e. the space around the crankshaft, is separated/sealed from the combustion chamber by the piston crown. The crankcase communicates with the scavenging pump through a hole, or port, at the wrist pin end of the piston. The valve is integral with the connecting rod and moves as a body with it. Depending on the leaning of the connecting rod relative to the cylinder axis, the communication of the space into the crankcase with the space into the scavenging pump through the port is allowed or it is prevented. The opening and the closing of the port by the valve are progressive without impact loads. The "periphery" or lip (16) of the valve cooperates with the port "periphery" or wall (14).
Figure 4:
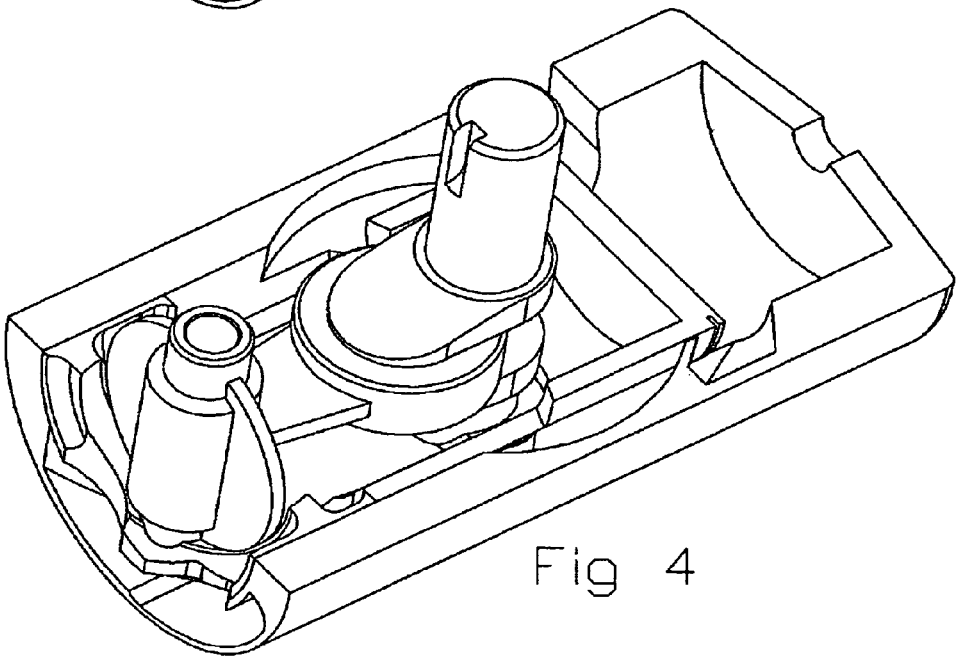
FIG. 4 shows what FIG. 3 with the piston sliced. The port starts opening by the valve.
Figure 5:
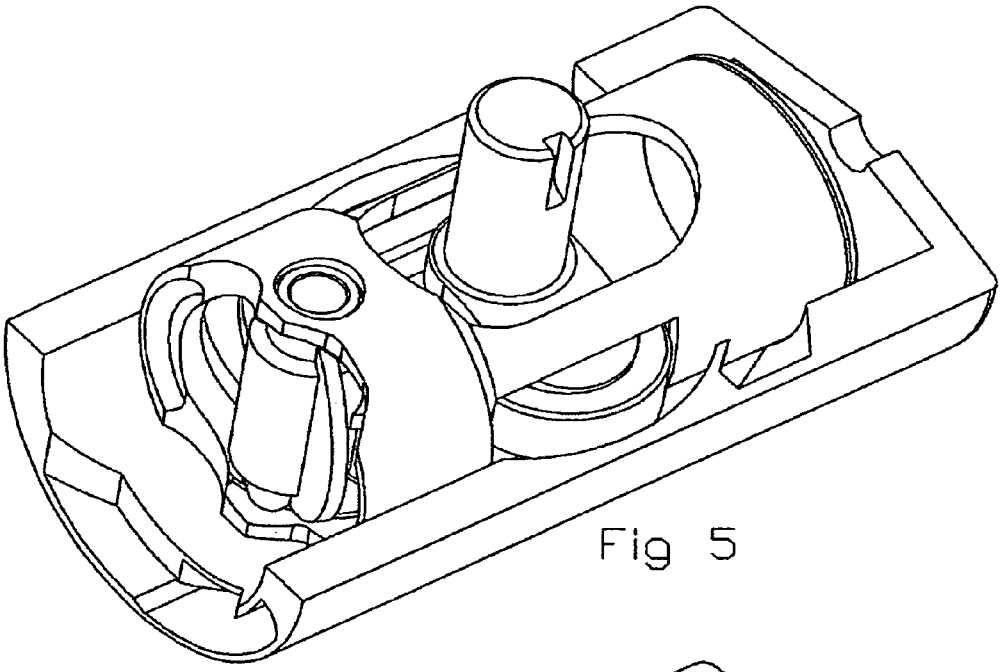
FIG. 5 shows what FIG. 3 with the piston at the compression middle stroke. The port is widely open: the connecting rod and the valve are at their maximum lean relative to the cylinder axis. The vacuum into the scavenging pump at left causes gas from the crankcase space to pass to the scavenging pump space through the port.
Figure 6:
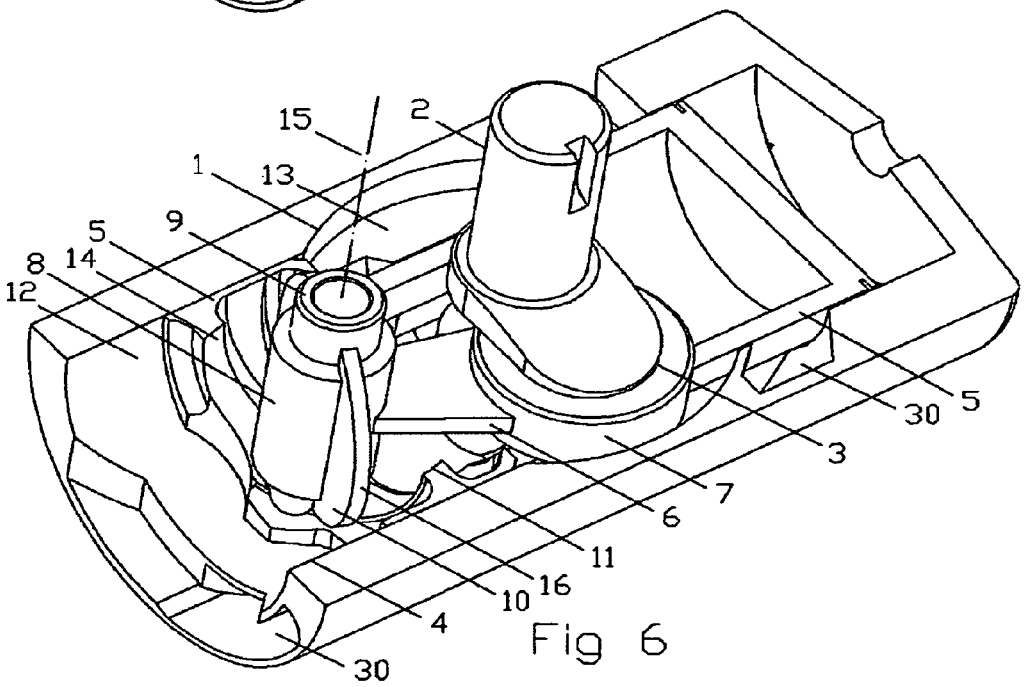
FIG. 6 shows what FIG. 5 with the piston sliced.
Figure 7:
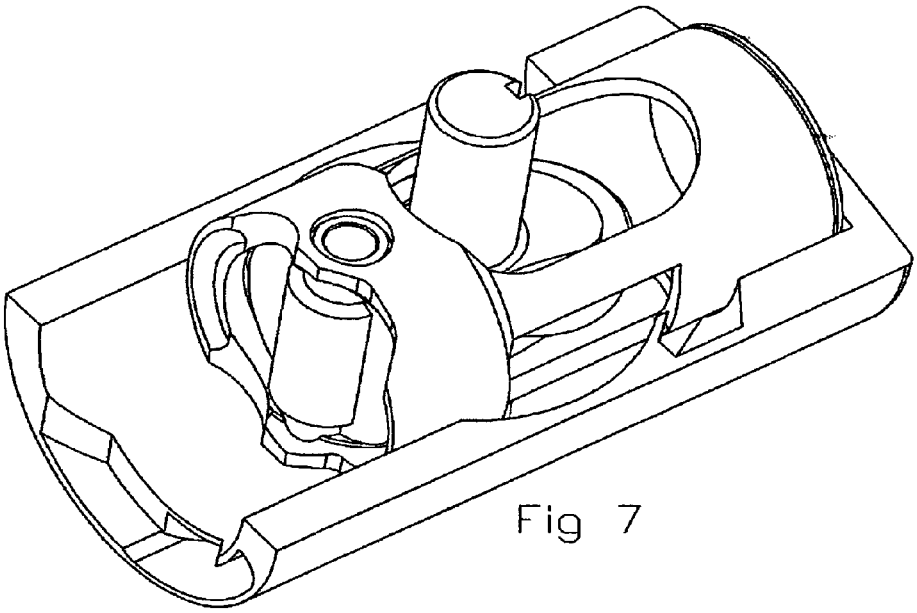
FIG. 7 shows what FIG. 3 with the piston at the TDC. The port is almost closed by the valve, trapping the gas previously sucked into the scavenging pump space; during the following expansion stroke the valve closes completely the port so that the trapped gas cannot return back to the crankcase space.
Figure 8:
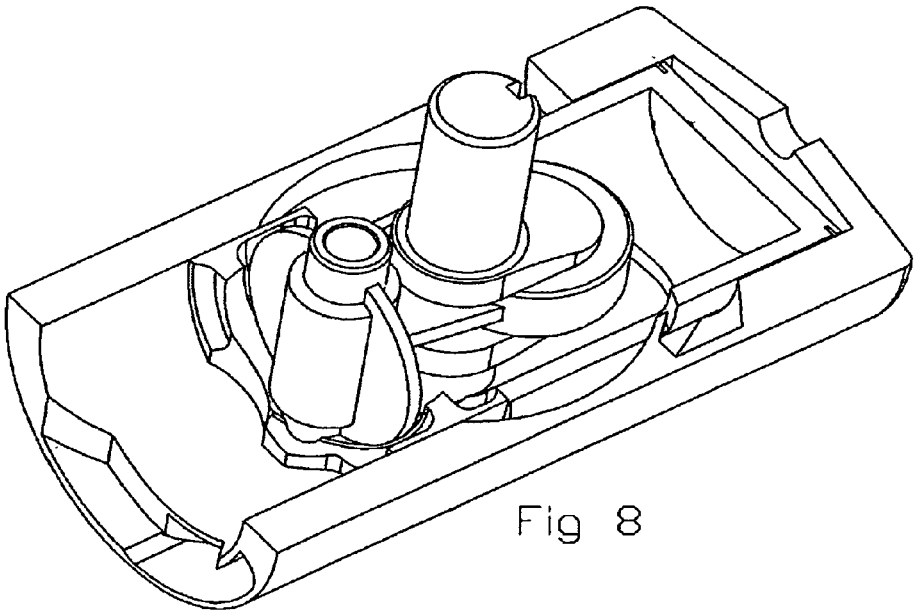
FIG. 8 shows what FIG. 7 with the piston sliced.
Figure 9:
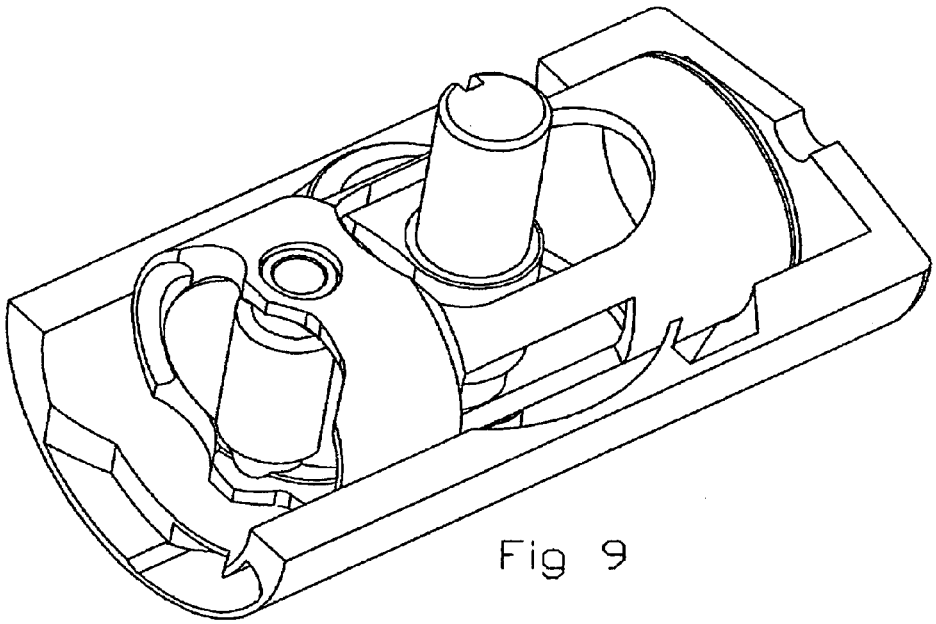
FIG. 9 shows what FIG. 3 with the piston at the expansion middle stroke. The port is completely closed. The air in the scavenging cylinder is compressed.
Figure 10:
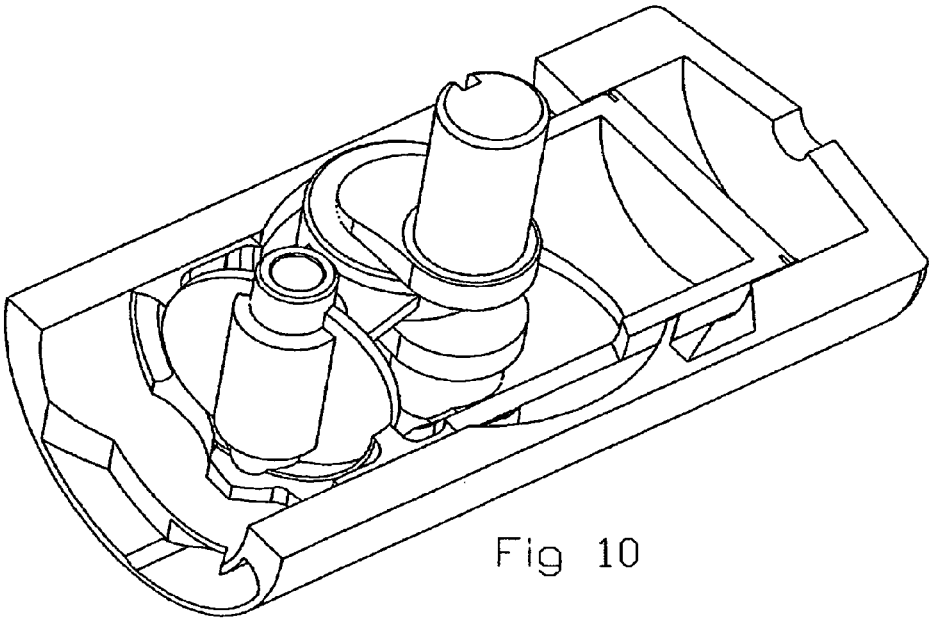
FIG. 10 shows what FIG. 9 with the piston sliced.
Figure 11:
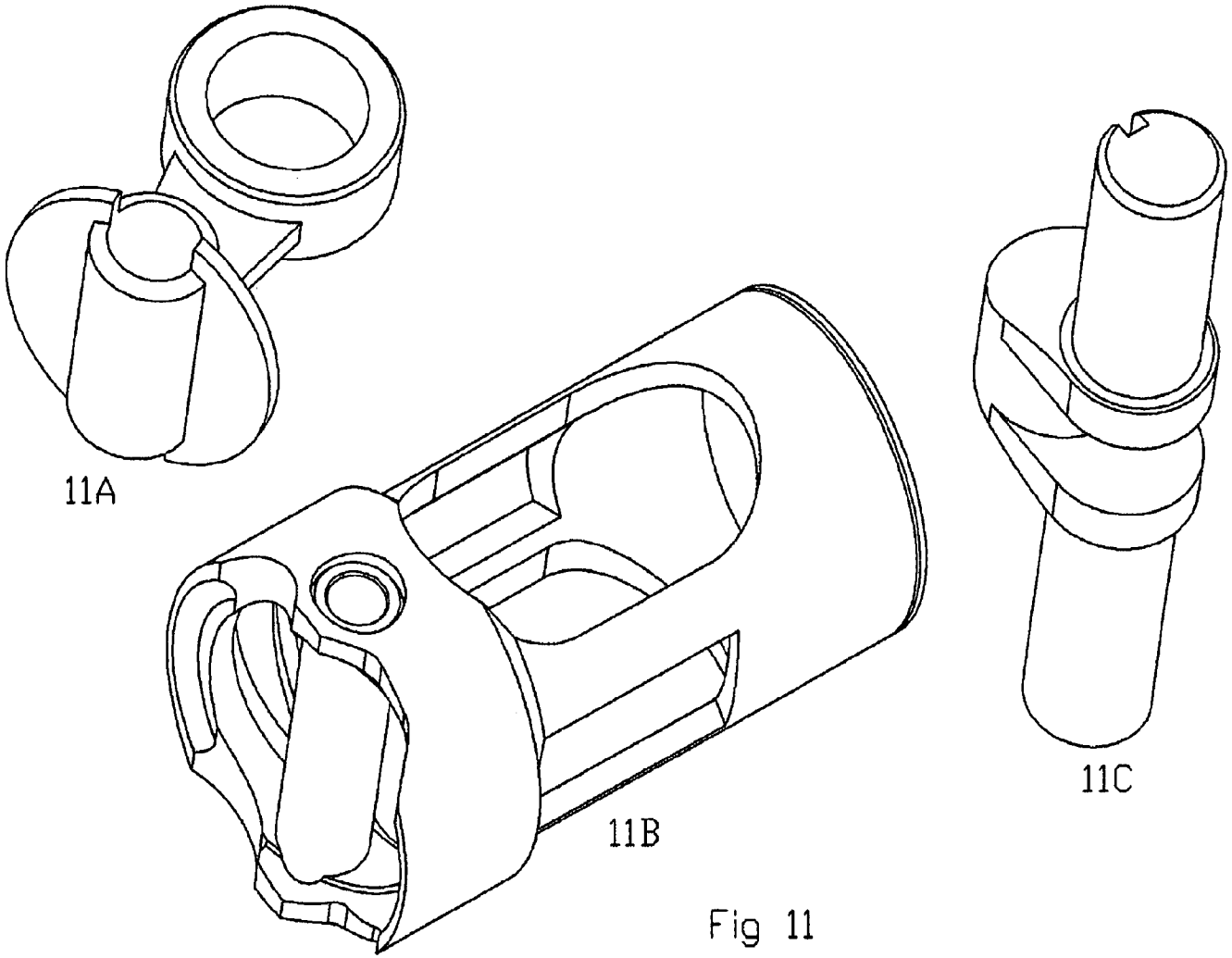
FIG. 11 shows the moving parts of the first embodiment. At left top (11A) it is the connecting rod with the valve on its small end. At the middle (11B) it is the piston with the wrist pin. At right (11C) it is the crankshaft.
Figure 12:
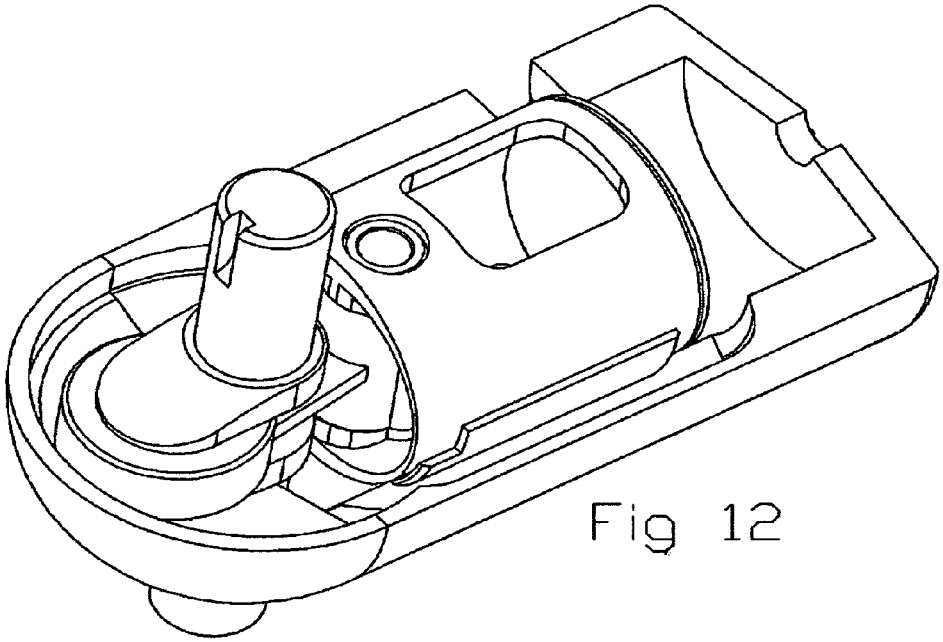
FIG. 12 shows a second embodiment. The engine is a push rod engine, i.e. a conventional engine.
Figure 13:
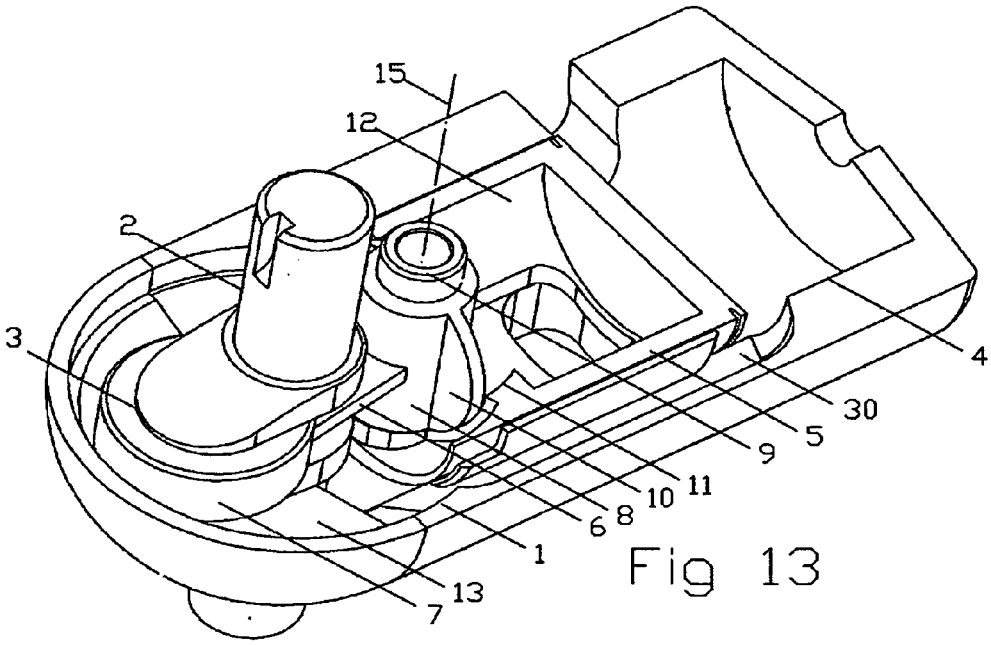
FIG. 13 shows what FIG. 12 with the piston sliced. Air or mixture enters through a port on the casing and a port on the piston skirt. The valve is closed so that the crankcase cannot communicate with the space inside the piston and under the piston crown.
Figure 14:
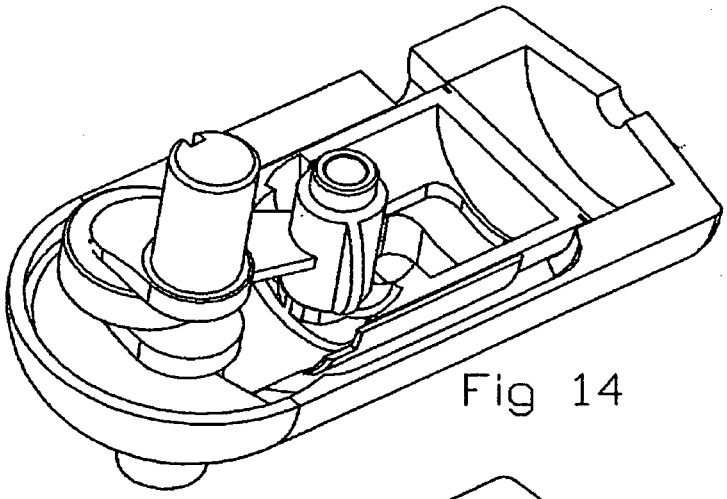
FIG. 14 shows what FIG. 13 with the piston at the compression middle stroke. The connecting rod and the valve are at their maximum leaning/slant relative to the cylinder axis so that the port is widely open allowing air from the space inside the piston to pass to the crankcase space.
Figure 15:
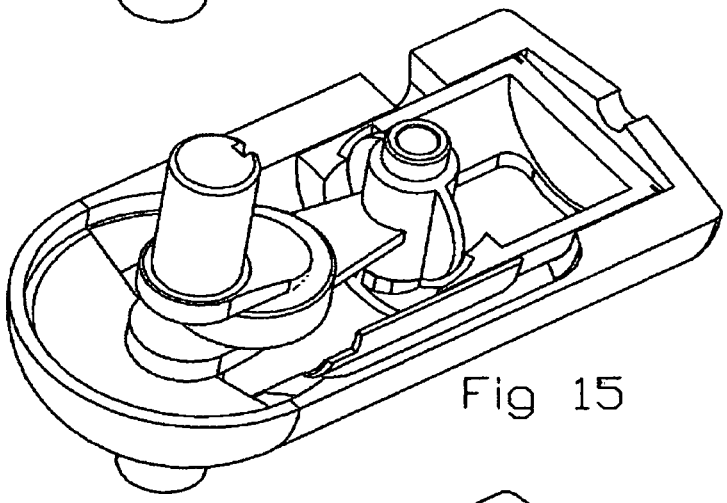
FIG. 15 shows what FIG. 13 with the piston at the TDC. The valve closes the port and the crankcase space cannot communicate with the space inside the piston any longer.
Figure 16:
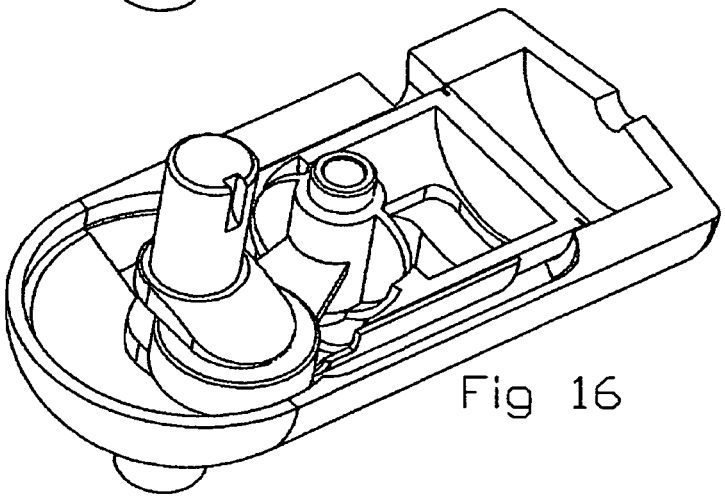
FIG. 16 shows what FIG. 13 with the piston at the expansion middle stroke. The port is completely closed and the air or mixture inside the crankcase is compressed.
Figure 17:
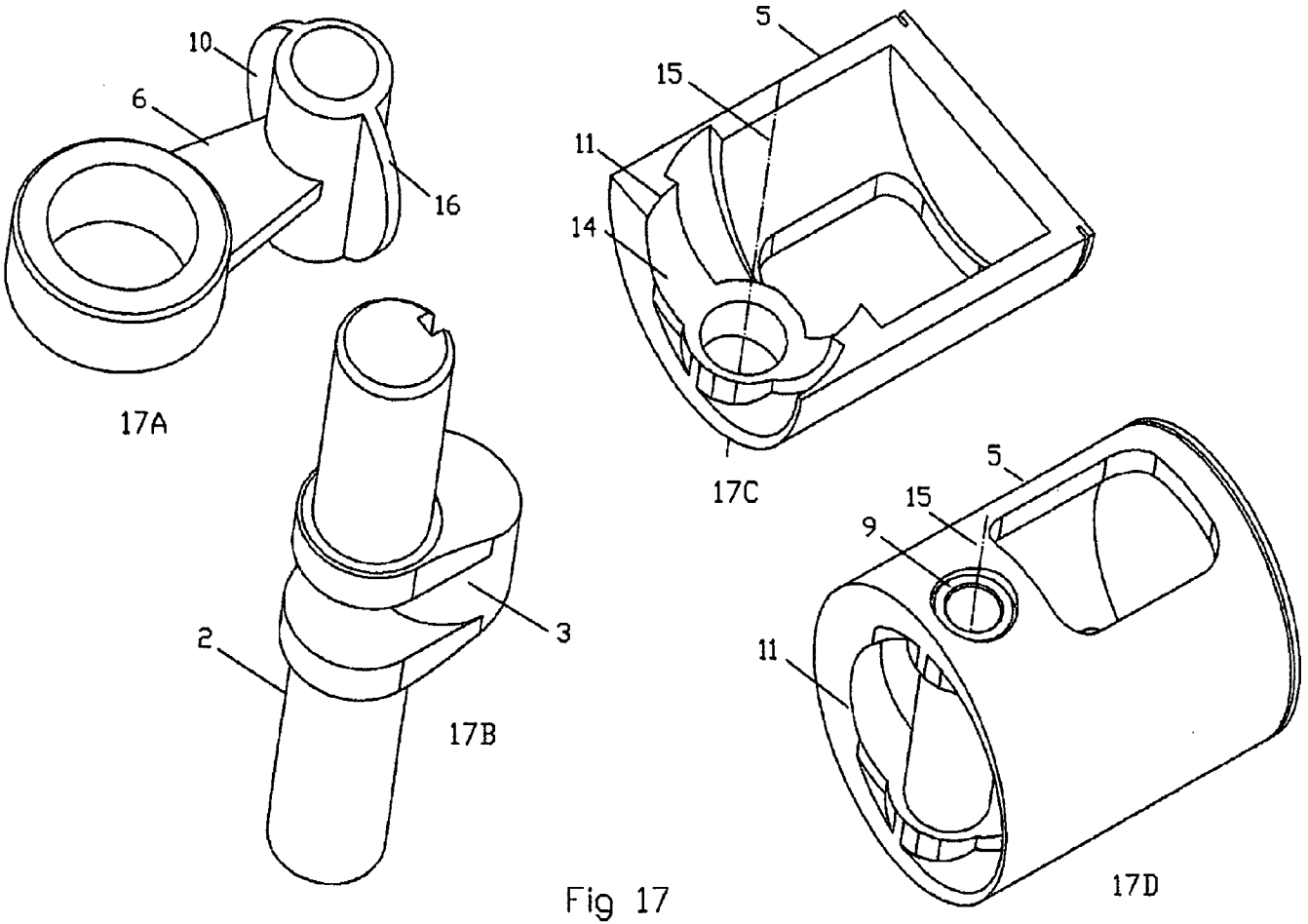
FIG. 17 shows the moving parts of the second embodiment. At top left (17A) it is the connecting rod with the valve at its wrist pin end. At right (17D) it is shown the piston with the wrist pin. At middle top (17C) it is shown the piston sliced. The port comprises a spherical wall (14). The valve has a spherical lip (16) that "fits" with the port wall (14). Alternatively, cylindrical surfaces, surfaces of revolution etc can be used. The working surface on the port and the respective working surface on the valve have to be compatible, i.e. to provide the necessary sealing of the spaces at the two sides of the port, when the port is closed by the valve.
Figure 18:
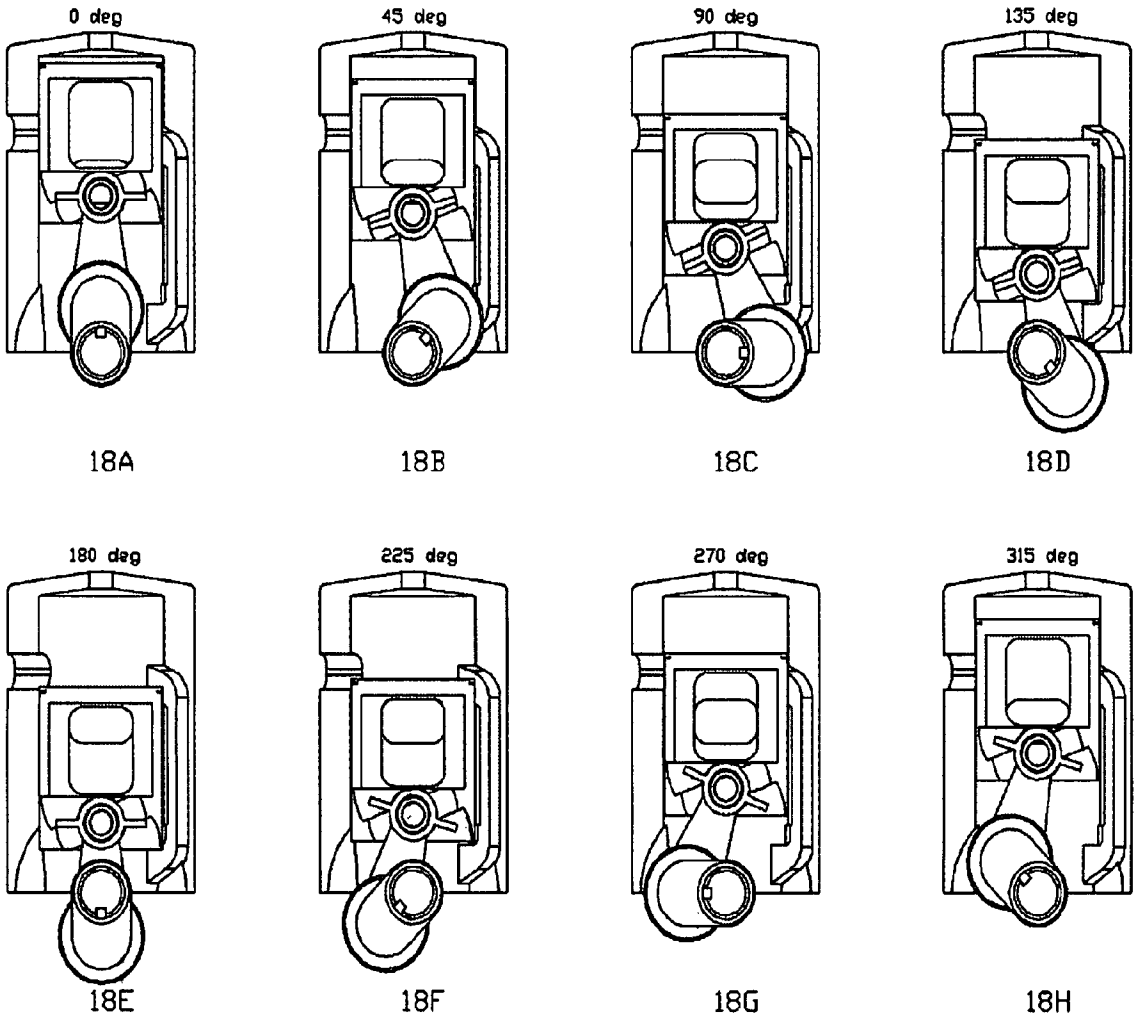
FIG. 18 shows the engine of the second embodiment at eight different crankshaft angles. The angle of the crankshaft defines the leaning of the connecting rod and of the valve relative to the port. The leaning of the valve relative to the port defines the condition of the port, i.e. if it allows, and how much/how freely, the communication of the crankcase with the space inside the piston.

In a first embodiment, FIGS. 1 to 11, the connecting rod has a valve (like a coin) secured at its small end. The piston has a port, i.e. an opening, surrounding or near the wrist pin.

The engine is a Pulling Rod Engine as disclosed in the U.S. Pat. No. 7,909,012. The scavenging bore is bigger than the combustion bore resulting in a more than one scavenging ratio. The small dead volume of the scavenging pump together with the longer dwell of the piston at the TDC and the crosshead architecture are among the advantages of this arrangement.

The crankshaft angle (together with the geometry) defines the angular displacement (i.e. the tilting or leaning) of the connecting rod relative to the piston, and so the angular displacement of the valve relative to the port. The tilting of the connecting rod maximizes near the middle stroke wherein the piston speed is also maximized.

At the compression middle stroke the valve keeps the port widely open. Air or mixture from the crankcase fills, through the open port, the space into scavenging pump. After the TDC the port closes by the valve; the space in the scavenging pump stops communicating with the crankcase. At the expansion middle stroke the port is completely closed by the valve; the air or mixture previously entered into the scavenging pump space is trapped and compressed. Then the exhaust port opens and the pressure inside the combustion chamber drops. Then the transfer port opens by the piston and the compressed air or mixture from the scavenging pump, through transfer ports (30), enters the cylinder and scavenges the burnt gas towards the exhaust. Then the valve opens the port. The vacuum inside the scavenging pump causes the flow of air or mixture from the crankcase towards the scavenging pump. And so on.

In a second embodiment, FIGS. 12 to 18, the engine is a conventional two-stroke engine (push rod engine). The space 12 under the piston crown is controllably isolated from the crankcase space 13 by means of the valve 10.

The valve, during the compression middle stroke, keeps the port 11 open. Air or mixture from the space 12 underneath the piston crown enters into the crankcase space 13.

The valve, during the expansion middle stroke, keeps closed the port. The air or mixture previously entered into the crankcase is now compressed. During the scavenging, the compressed air or mixture from the crankcase enters, though the transfer port, into the cylinder and scavenges the burnt gas out of the exhaust port. And so on.

Figure 19:
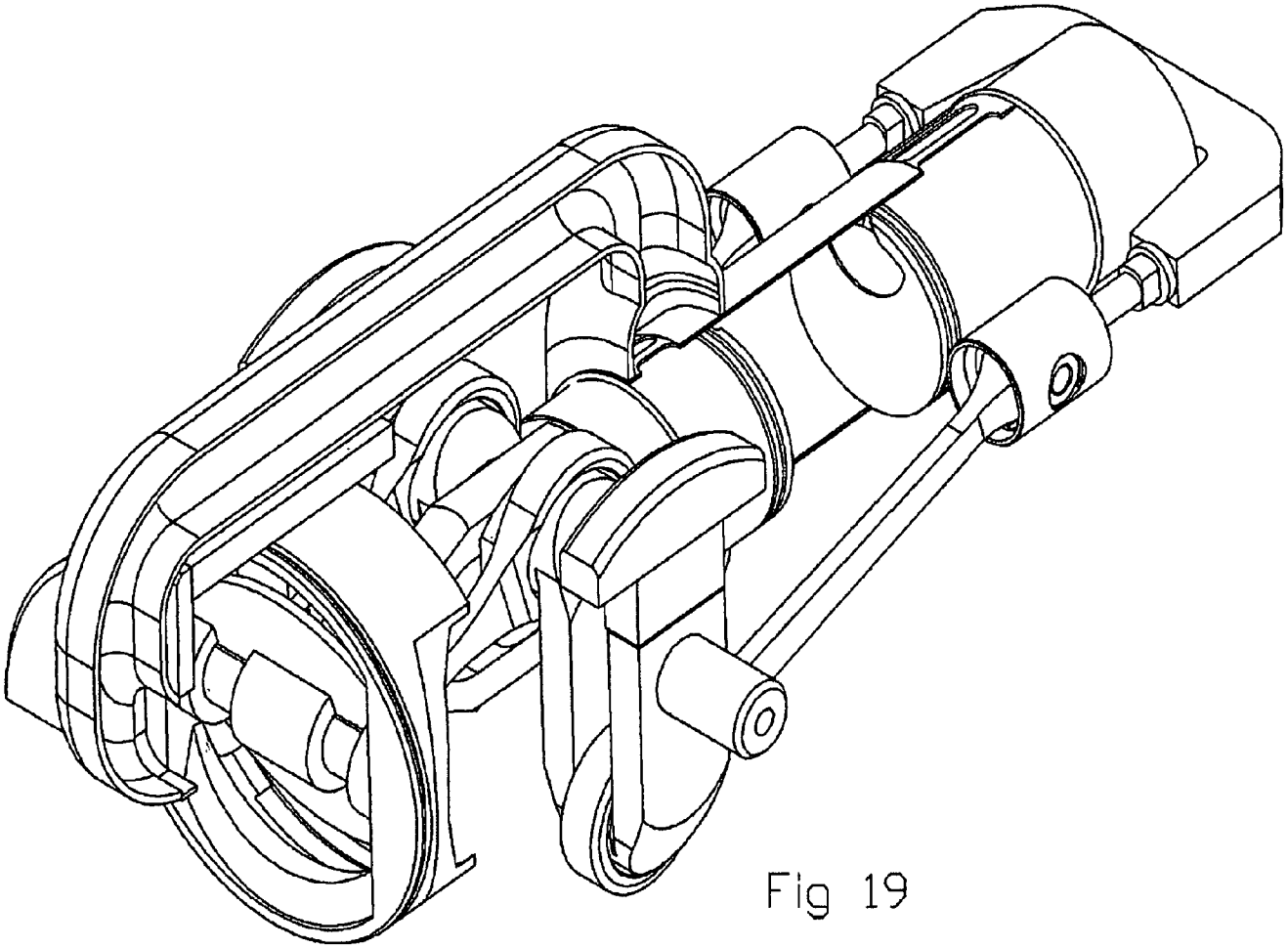
FIG. 19 shows a third embodiment. Here an opposed-piston single-crankshaft pulling-rod engine (GB2,482,750) is using in its scavenge piston (which is the big diameter piston at left) a valve for the control of the communication of the crankcase with the scavenging pump space. The valve is secured to the two short connecting rods.
Figure 20:
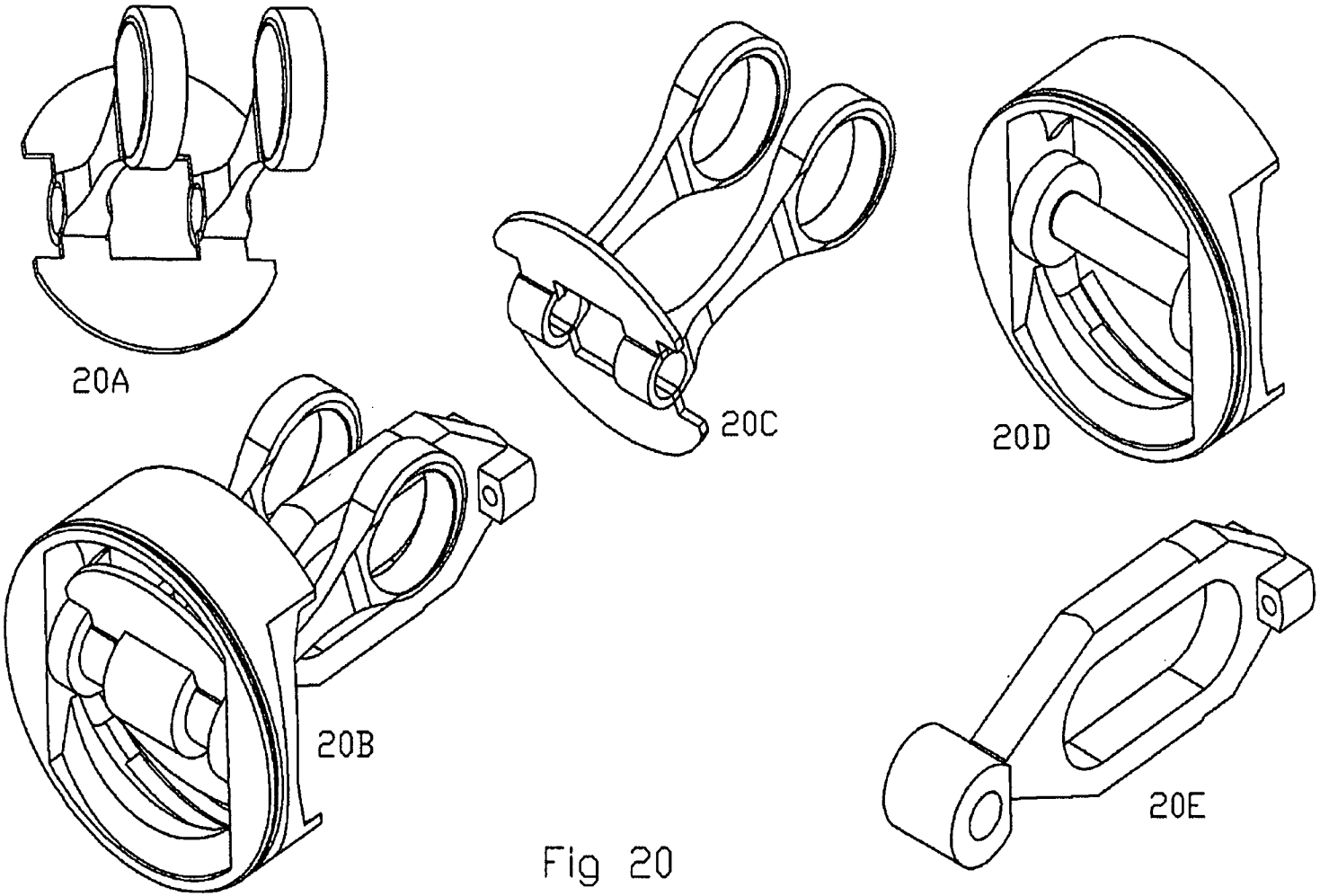
FIG. 20 shows the scavenging pump piston of the third embodiment. At top left (20A) and at the middle (20C) it is shown from two different viewpoints the pair of the short connecting rods with the valve. At right (20E) it is the member that connects the wrist pin with the combustion piston (not shown). At left bottom (20B) it is the assembly of the parts. At right top (20D) it is the scavenging piston with the wrist pin. The opening of the scavenging piston is the port that cooperates with the valve.
Figure 21:
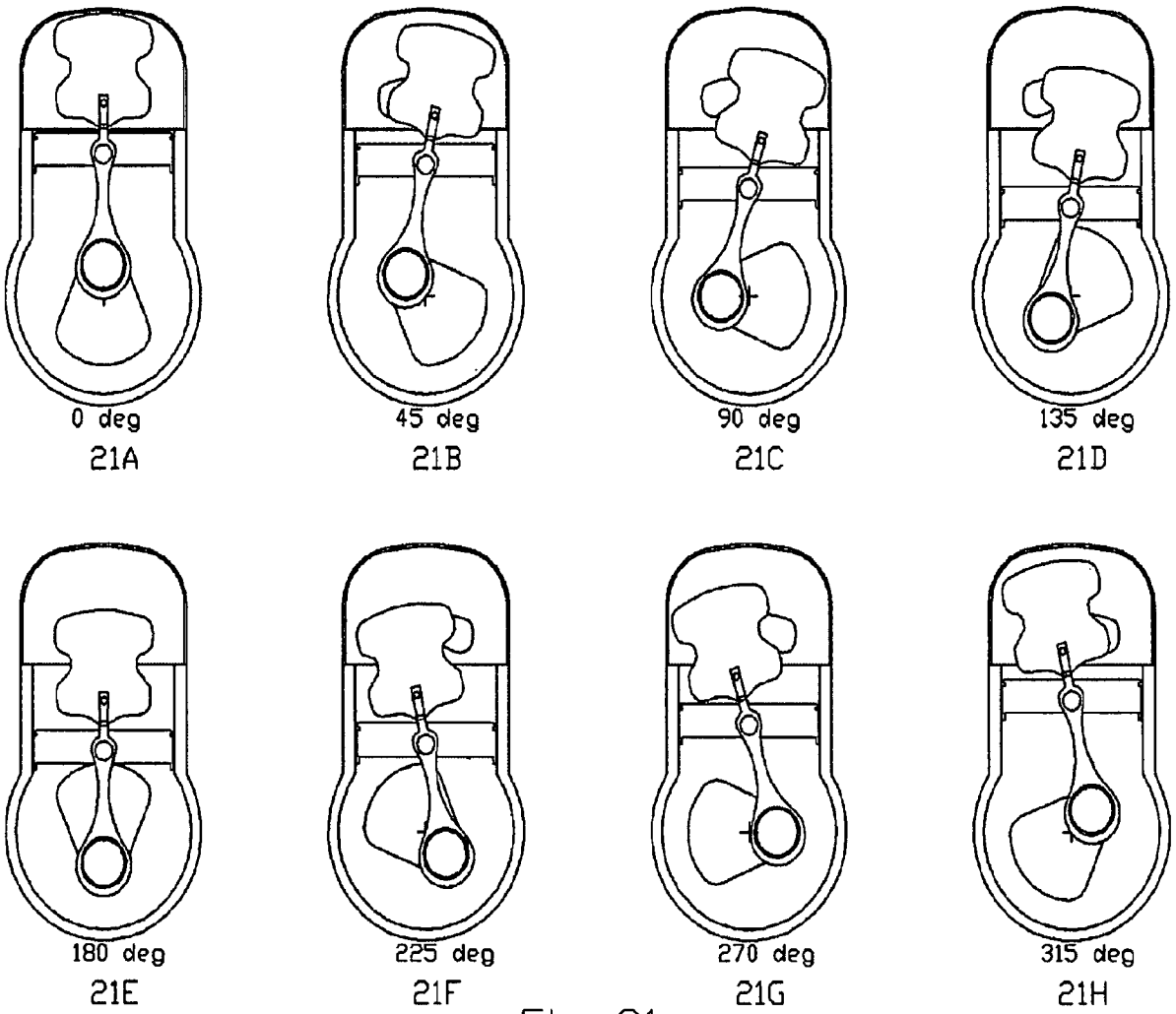
FIG. 21 shows a fourth embodiment. It is a reciprocating piston pump (or compressor). It is shown at eight crank angles (at top left (21A) the pump is at the TDC). The valve moves inside the compression chamber; the valve progressively covers and uncovers intake and exhaust ports made on the cylinder head of the compressor.
Figure 22:
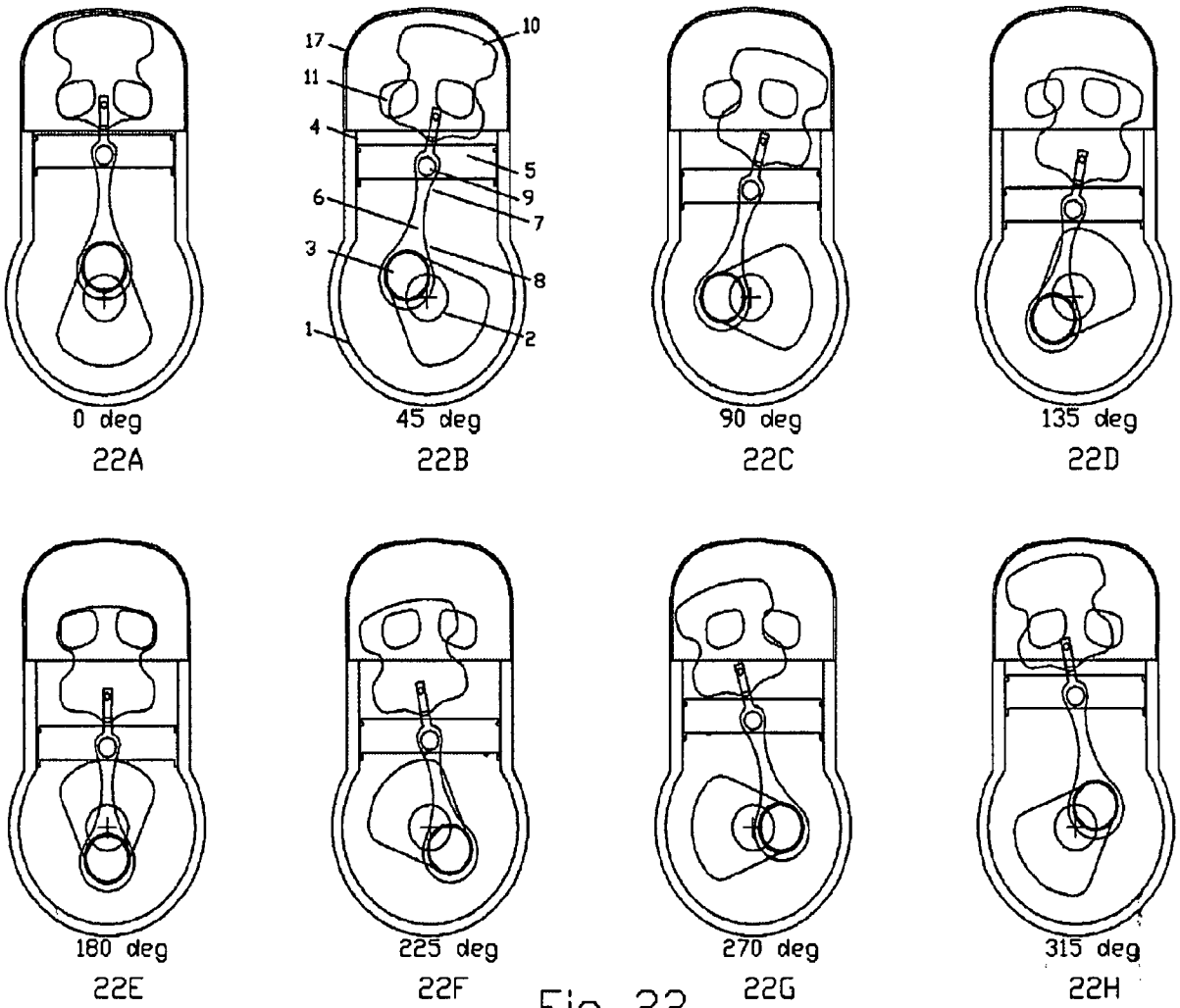
FIG. 22 shows what FIG. 21 with the parts "transparent".
Figure 23:
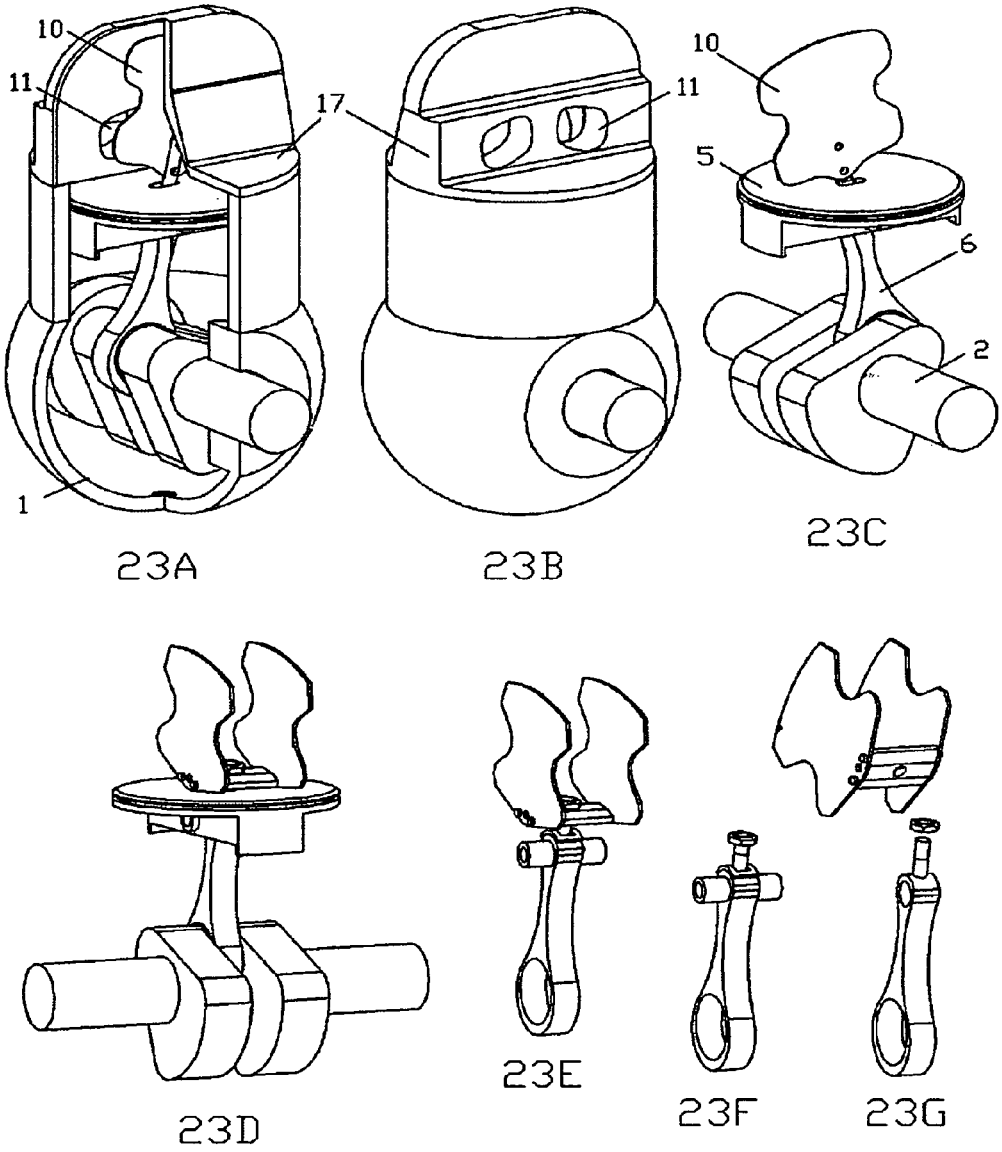
FIG. 23 shows at top (23A, 23B), from two viewpoints, the fourth embodiment with the cylinder and the cylinder head properly sliced; the one port is the intake port, the other is the exhaust port; at top right (23C) they are shown the three moving parts. At bottom
Figure 24:
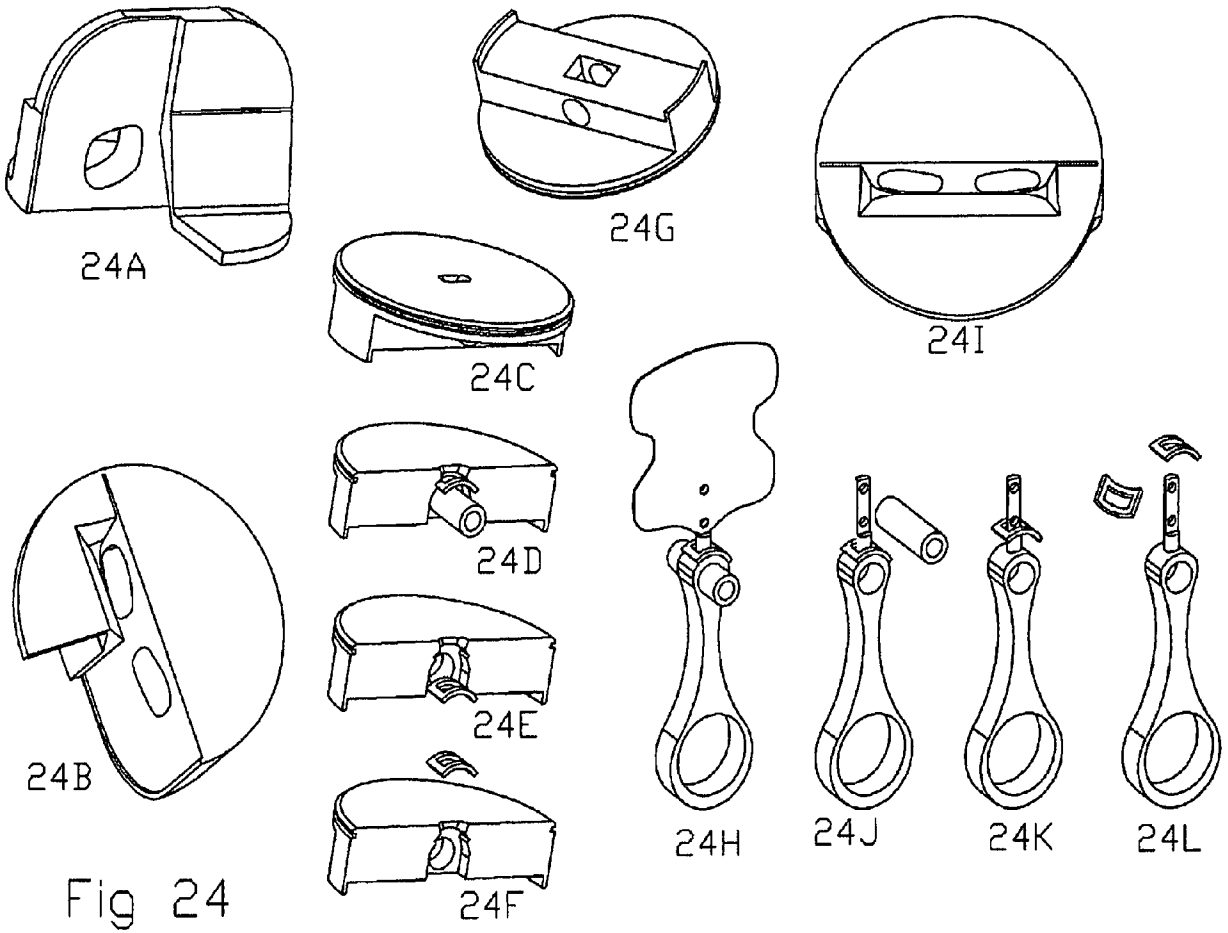
FIG. 24 shows the parts of the fourth embodiment in more details. At left (top and bottom, 24A, 24B) and at right top (241) it is shown, from various viewpoints, the chamber/channel formed into the cylinder head facing the ports. At middle (24C, 24D, 24E, 24F and 24G) it is shown the piston complete and sliced. At bottom right (24H, 24J, 24K and 24L) it is shown the connecting rod with the valve secured on a projection of the connecting rod at the wrist pin side of the connecting rod. It is also shown the seal disposed between the piston and the connecting rod, around the connecting rod projection; this seal together with the piston rings prevent the lubricant from the crankcase to enter into the compression chamber.
Figure 25:
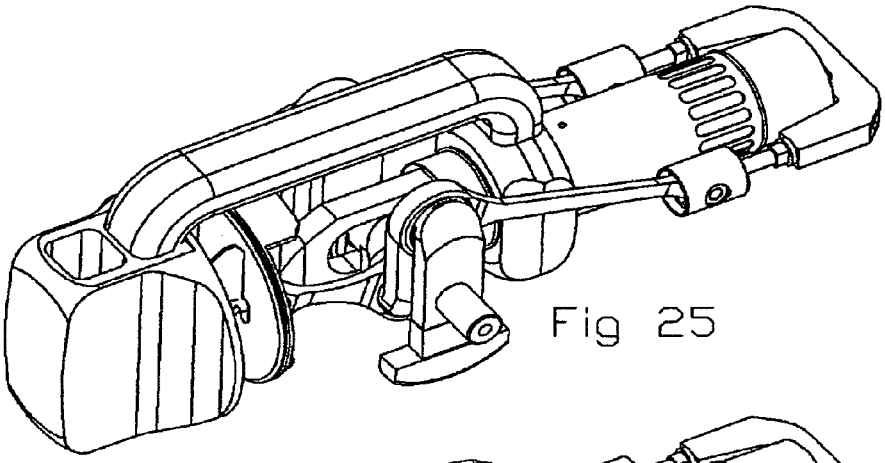
FIG. 25 shows a fifth embodiment wherein the scavenging pump of an opposed-piston single-crankshaft pulling-rod engine (GB2,482,750) is made according the present invention. There are two intake ports and two exhaust ports on the cylinder head. A transfer pipe connects the two exhaust ports of the cylinder head with the plenum around the combustion cylinder intake ports. An intake pipe feeds air (or mixture) to the two intake ports of the cylinder head.
Figure 26:
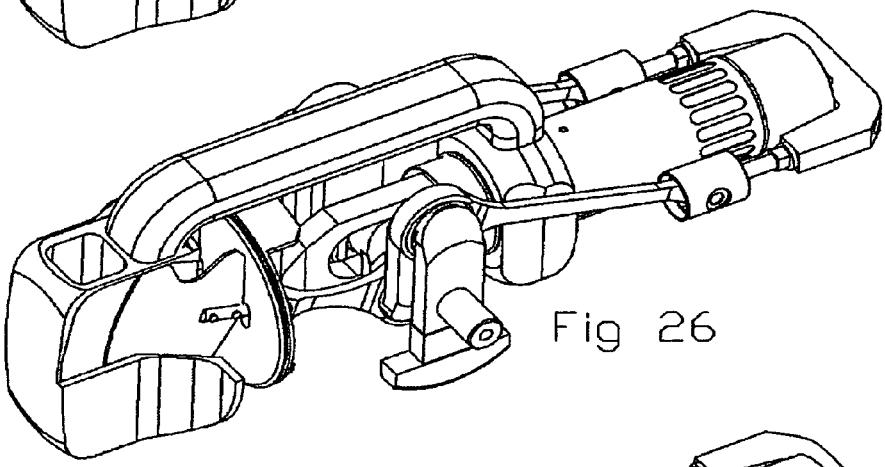
FIG. 26 shows the fifth embodiment with the cylinder head sliced to show the one valve.
Figure 27:
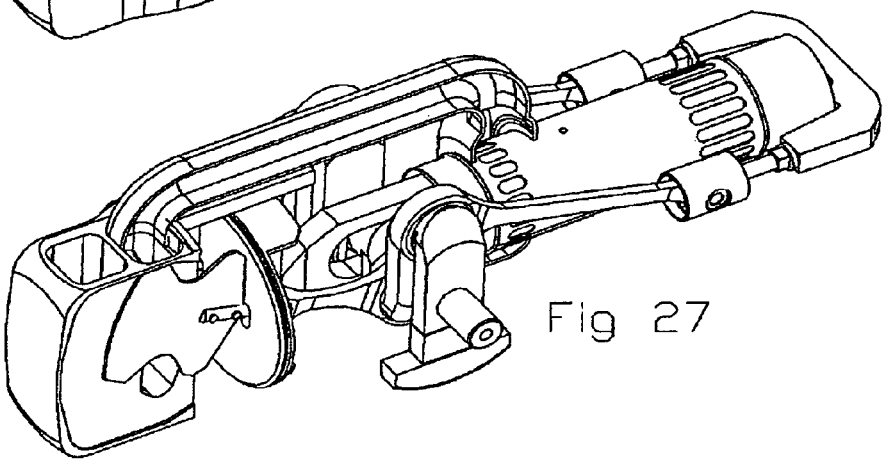
FIG. 27 shows the fifth embodiment with the cylinder head sliced; the transfer pipe is also sliced; the intake port is partially uncovered by the valve, while the exhaust port (not shown) is completely covered (i.e. closed) by the valve. The sub-pressure inside the chamber of the scavenging pump and the open intake ports allow air, through the intake pipe, to enter into the chamber of the scavenging pump.
Figure 28:
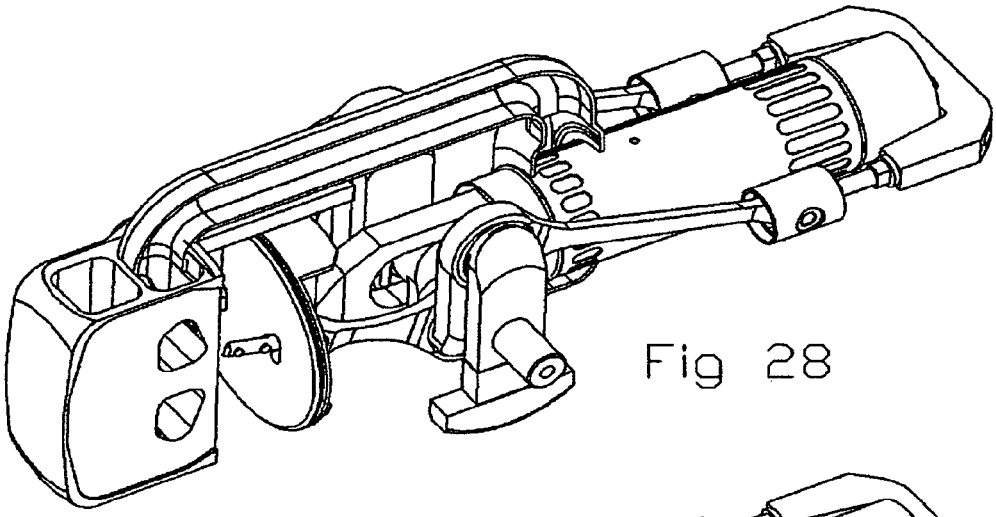
FIG. 28 shows what FIG. 27 with the valve removed. Both ports are shown.
Figure 29:
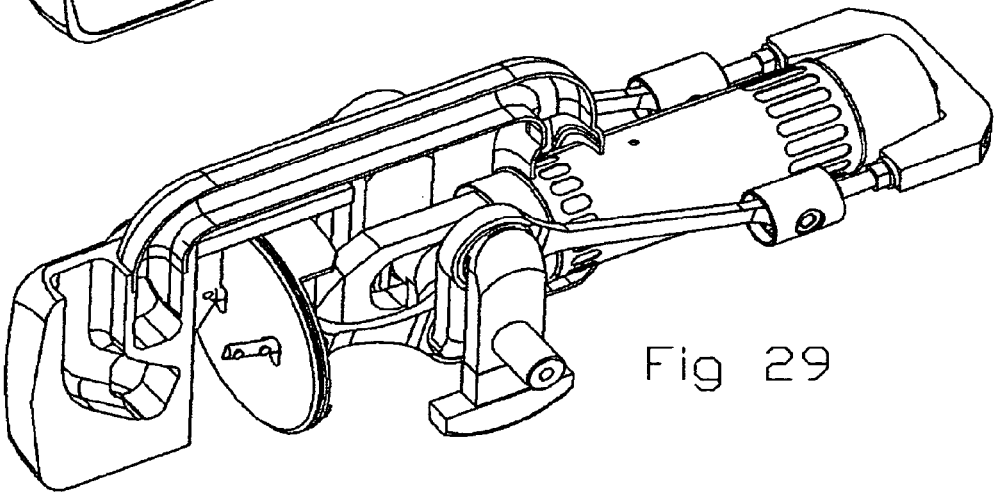
FIG. 29 shows the fifth embodiment with the cylinder head sliced in the middle (the removed "half" is symmetrical to the shown "half"); the valve is removed. The form of the intake and exhaust pipes is shown.
Figure 30:
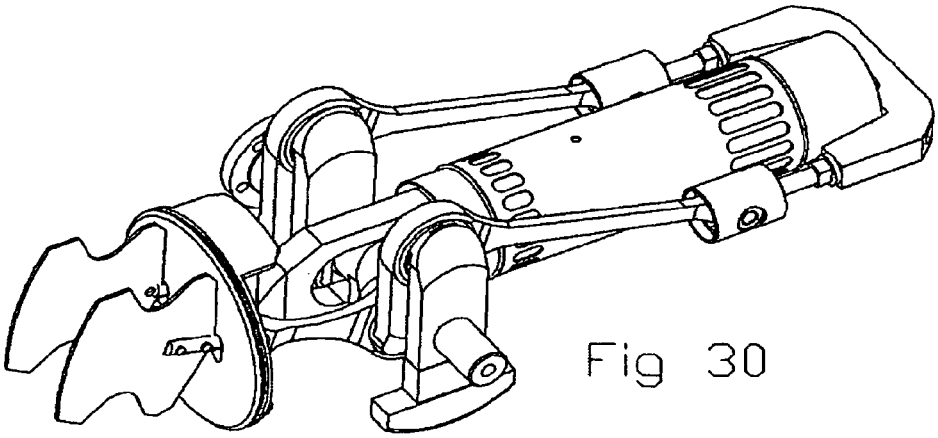
FIG. 30 shows the fifth embodiment with the cylinder head, the cylinder of the scavenge pump and the transfer pipe removed. There are two valves (one per connecting rod of the scavenge pump piston). The big diameter scavenge piston has two openings through which projections of the two connecting rods extend into the chamber of the scavenging pump. One valve is secured on each connecting rod.
Figure 31:
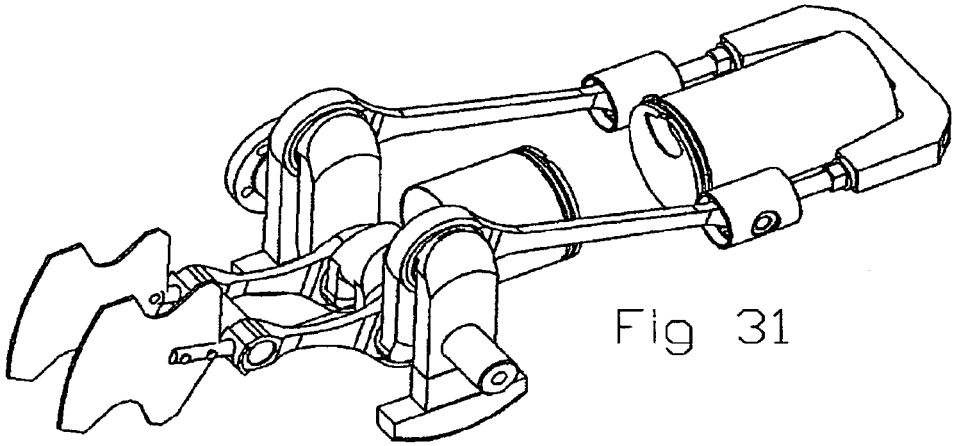
FIG. 31 shows what FIG. 30 with the piston of the scavenging pump and the combustion cylinder removed.
Figure 32:
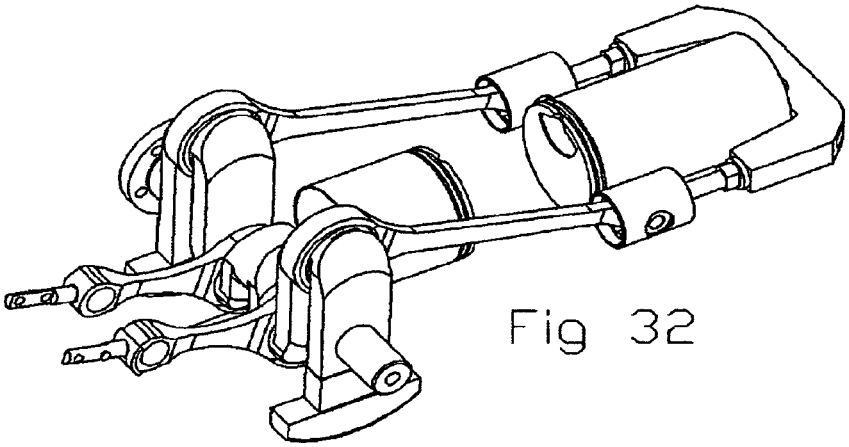
FIG. 32 shows what FIG. 31 with the valves and the wrist pin removed.
Figure 33:
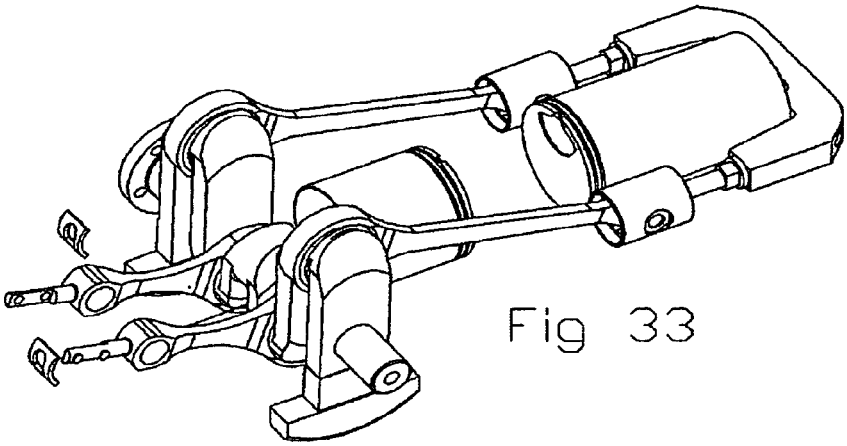
FIG. 33 shows what FIG. 32 with the sealing means (those interposed between the connecting rods and the scavenge pump piston, around the connecting rod projections) displaced away from their normal position.
Figure 34:
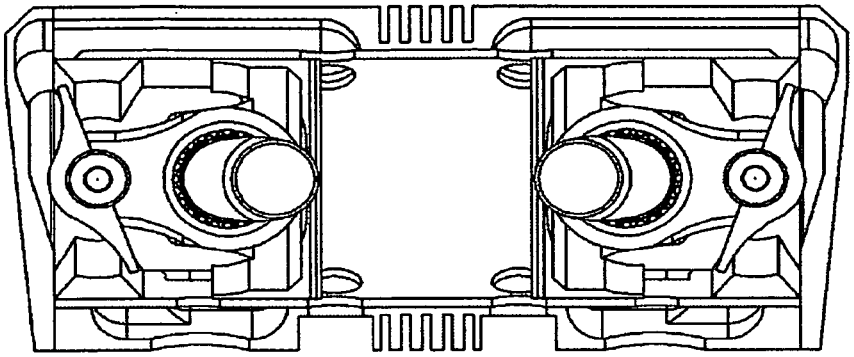
FIG. 34 shows a sixth embodiment wherein an opposed-piston pulling-rod engine (U.S. Pat. No. 7,909,012, GB2,449,031) is using the connecting-rod-valve of the present invention at its two scavenging pumps. The engine is substantially over-square (the bore to piston-stroke ratio is 2.8 here). The ports shown at the upper side of the cylinder are the transfer ports. The ports shown at the lower side of the cylinder are the exhaust ports. The extra over-square design and the arrangement of the ports enable a cross uniflow scavenging. The pistons are shown at the BDC. The compressed gas from the two scavenging pumps passes through the open, by the piston, transfer ports and scavenges the cylinder.
Figure 35:
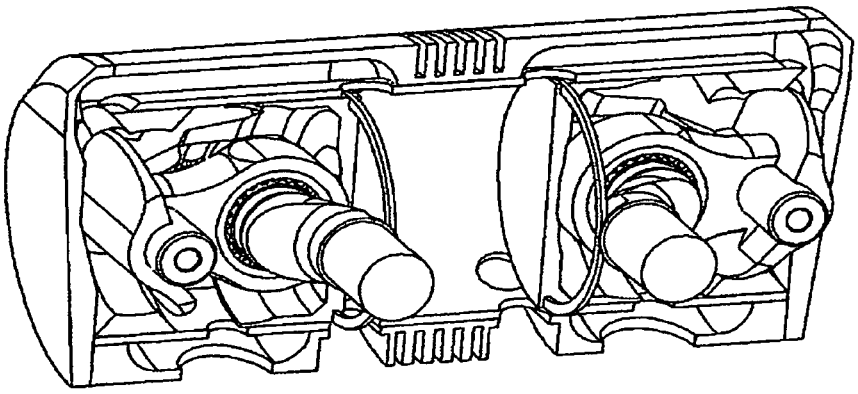
FIG. 35 shows what FIG. 34 from a different viewpoint.
Figure 36:
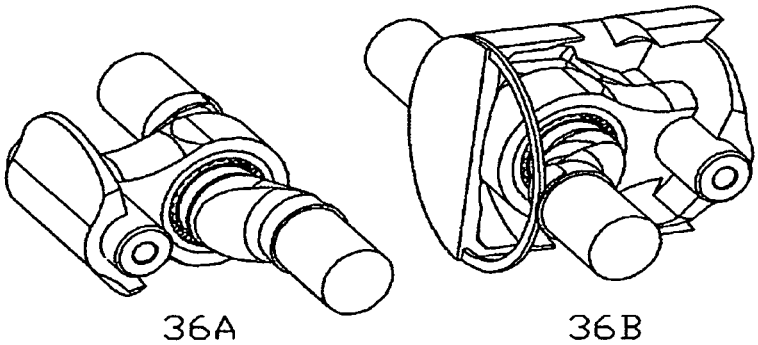
FIG. 36 shows at left (36A) the assembly of the one crankshaft with its connecting rod (the valve is at the small end side of the connecting rod and is integral with the connecting rod); at right (36B) it is shown the assembly of the other crankshaft with its connecting rod and piston (the piston is spliced).
Figure 37:
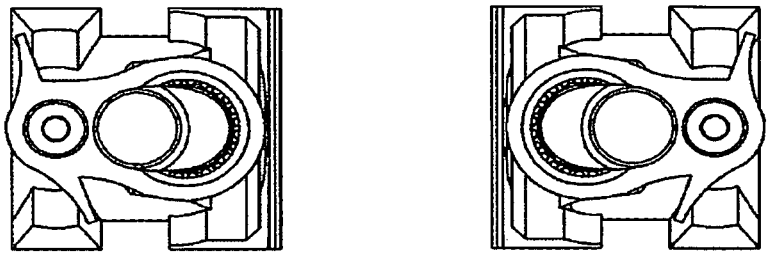
FIG. 37 shows the moving parts of the sixth embodiment at the BDC. At left (37A) is the assembly of the one crankshaft with its connecting rod and piston, at right (37B) is the assembly of the other crankshaft with its connecting rod and piston. The ports on the pistons, around the wrist pins, have just open. The pistons and the connecting rods are sliced.
Figure 38:
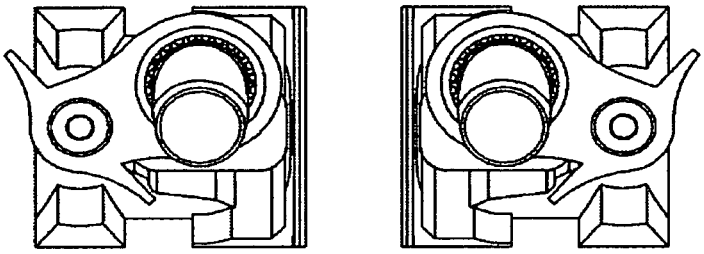
FIG. 38 shows the moving parts of the sixth embodiment at 90 crankshaft degrees after the BDC. At left (38A) is the assembly of the one crankshaft with its connecting rod and piston, at right (38B) is the assembly of the other crankshaft with its connecting rod and piston. Here the ports are widely open. As the two opposed pistons approach to each other, the sub-pressure inside the scavenging pumps causes gas from the two crankcases (i.e. actually from the spaces inside the pistons) to pass through the ports and fill the spaces in the scavenging pumps.
Figure 39:
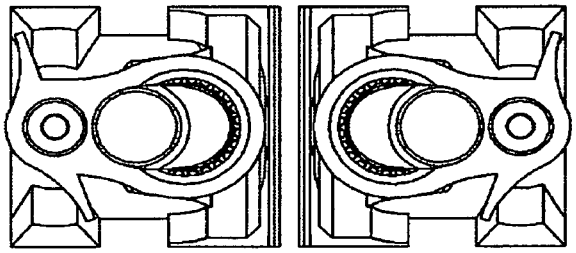
FIG. 39 shows the moving parts of the sixth embodiment at the TDC (wherein the volume inside the combustion chamber is minimized). At left (39A) is the assembly of the one crankshaft with its connecting rod and piston, at right (39B) is the assembly of the other crankshaft with its connecting rod and piston. The ports are almost closed.
Figure 40:
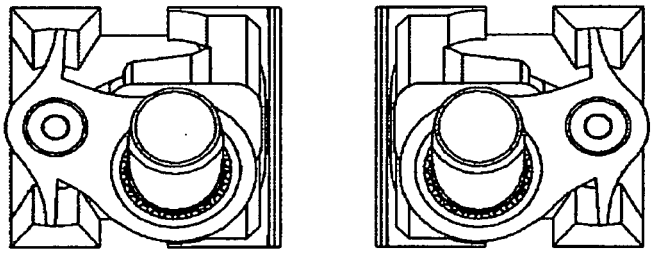
FIG. 40 shows the moving parts of the sixth embodiment at 90 crankshaft degrees after the TDC (middle stroke). At left (40A) is the assembly of the one crankshaft with its connecting rod and piston, at right (40B) is the assembly of the other crankshaft with its connecting rod and piston. The ports are completely closed by the valves, the gas inside the scavenging pumps is compressed. Soon the transfer ports will open by the pistons and the scavenging of the combustion cylinder will begin.
Figure 41:
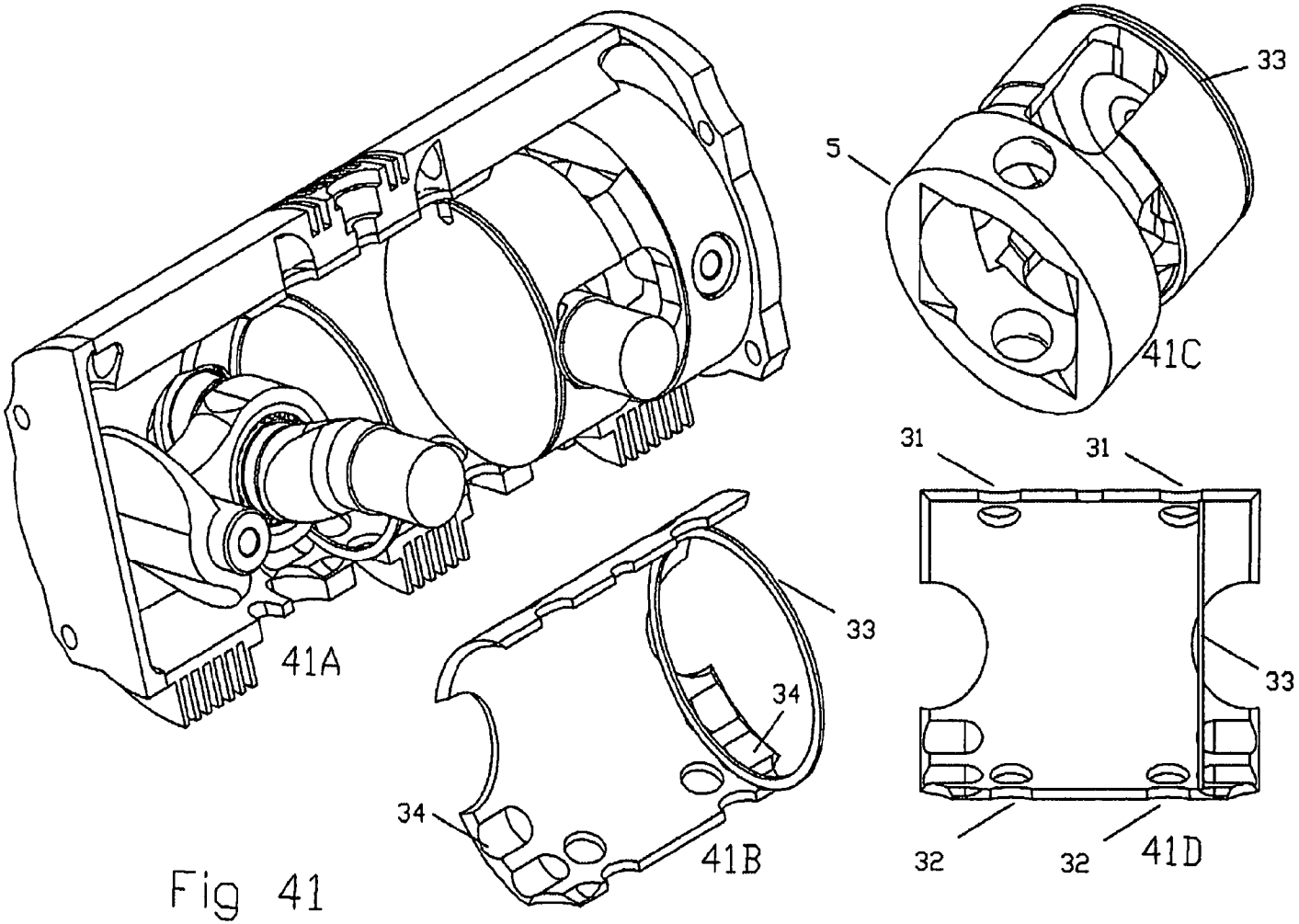
FIG. 41 shows the sixth embodiment on another opposed piston pulling rod engine (U.S. Pat. No. 7,909,012, GB2,449,031). In this case the scavenging pump bore is bigger than the combustion bore (over-scavenging). At top left (41A) it is shown the engine sliced. The left piston is removed; its piston ring remains on the cylinder liner. At right top (41C) the piston 5 and its piston ring 33 are shown from a different viewpoint. At bottom middle (41B) and bottom right (41D) it is shown the cylinder liner sliced, with the one piston ring at its BDC position. At the edges of the cylinder liner recesses 34 are cut; the fresh charge finds the way to reach (and cool, and lubricate "directly") the piston ring and the top piston skirt (as well as the area of the exhaust port and the surroundings) "from outside the combustion chamber", when the piston is near the BDC.

In a third embodiment, FIGS. 19 to 20, a single crankshaft opposed piston engine, as disclosed in the GB2,482,750, uses the connecting rod valve in its scavenging pump.

In a fourth embodiment, FIGS. 21 to 24, the connecting rod of a pump/compressor has a projection extending, through an opening on the piston, into the chamber of a pump. On the projection of the connecting rod it is secured a valve. The cylinder head comprises intake and exhaust ports. The valve, following the motion of the connecting rod, covers and uncovers successively the intake and exhaust ports in synchronization to the crankshaft, realizing an intake or suction cycle, then a compression or exhaust cycle and so on, as in the conventional poppet valve pumps/compressors. In a variant, with the proper geometry of the ports and valve, the compression cycle can proceed substantially before the opening of the exhaust port to avoid the reciprocation of the compressed gas back to the chamber and so to improve the efficiency.

In a fifth embodiment, FIGS. 25 to 33, the scavenging pump of a two-stroke single-crankshaft opposed-piston engine, as disclosed in the GB2,482,750, comprises a cylinder head and two valves. The scavenging pump piston is connected to the crankshaft by a pair of connecting rods, each comprising a projection. The scavenging pump piston has two openings through which the connecting rod projections enter into the chamber of the scavenging pump. Sealing means disposed between the piston and the connecting rods seal the chamber of the scavenging pump from the crankcase. A valve is secured to the projection of each connecting rod. The two exhaust ports communicate with the plenum around the ports of the combustion cylinder through a transfer pipe. A common intake pipe feeds the two intake ports with air or mixture.

In a sixth embodiment, FIGS. 34 to 41, the connecting rod valve is applied on an opposed-piston pulling-rod engine (U.S. Pat. No. 7,909,012, GB2,449,031). This opposed piston design has a big bore to stroke ratio, which allows high rewing. The big bore allows large valves and ports, i.e. high flow capacity. With the two sets of transfer ports 31 (one per piston) arranged ant diametrically to the respective sets of exhaust ports 32, and with the shallow combustion chamber, the scavenging is cross uniflow. The small dead volume of the scavenging pumps enables efficient scavenging in a wide range of revs and loads and needs not a resonance exhaust (Kaaden). The valves need not to touch the ports; an adequately small clearance between the valve and the port (say 0.05 mm; the small clearance in the range of 0.01 to 0.02 mm—of the typical wrist pin makes it easy) is all it takes for a good sealing between the crankcase and the space into the scavenging pump; without contact between the cooperating surfaces (valve to port), there is neither wear, nor friction, nor mechanical noise. The fresh charge entering into the crankcase (actually into the piston) cools the backside of the piston crown (there is no wrist pin there to hide the piston crown).

With the thrust loads taken away from the combustion chamber, on the relatively cold (and rid of ports) cylinder walls of the scavenging pumps, the specific lube consumption can substantially be reduced. With the fresh charge entering nearby the exhaust ports 32, the temperature of the exhaust side of the piston skirt that opens and closes the exhaust ports, reduces (it is wherein most failures—piston seizure—of the conventional two strokes start). The specific lube consumption can further reduce: instead of lubricating the cylinder liner and the piston rings with the lube carried by the warmed charge that, through the transfer ports, enters into the combustion chamber, the lubrication can be realized "directly", "outside the combustion chamber" by the fresh charge that falls onto the piston skirts and onto the backside of the piston ring.

All the six embodiments belong to the same species because: they all have a valve secured to the connecting rod (at its wrist pin side), they all have a port between two spaces, in all of them the valve sealingly fits with the port, in all of them the valve opens and closes the port in synchronization to the crankshaft allowing or stopping the flow of the working gas from the one space to the other through the port under the action of the piston.

Although the invention has been described and illustrated in detail, the spirit and scope of the present invention are to be limited only by the terms of the appended claims.

What is claimed is:

1. A reciprocating piston positive displacement machine comprising at least:

a crankcase (1);

a crankshaft (2) rotatably mounted on said crankcase (1), said crankshaft (2) is comprising a crank pin (3);

a cylinder (4);

a piston (5) slidably fitted in said cylinder (4), said piston (5) sealing one side of a space (12) defined by said piston (5) and said cylinder (4), said piston (5) having a first end adjacent said space (12) and a second end;

a connecting rod (6) rotatably mounted at a first end (7) on said crankpin (3) and pivotally mounted, at a second end (8), on said piston (5) by a wrist pin (9) so that rotation of the crankshaft (2) causes reciprocation of the piston (5) inside the cylinder (4);

a valve (10) integral with, or secured to, said connecting rod (6) at the second end (8); and a port (11) on the first end of said piston (5), the port (11) is disposed between said space (12) and a second space (13) inside the crankcase (1), the rotation of the crankshaft (2) causes the tilting of the valve (10) relative to the piston (5) about the wrist pin (9), for a portion of the rotation the valve (10) keeps open the port (11) allowing a substantially free flow of a working gas between the space (12) and the second space (13); and, for another portion of the rotation the valve (10) keeps the port (11) closed preventing the communication of the space (12) with the second space (13) and enabling a compression of the working gas.

2. A reciprocating piston positive displacement machine according to claim 1, wherein:

the valve is in sealing cooperation with the port so that, depending on the crankshaft angle, the port is from substantially open, allowing the free communication of the two spaces, to substantially closed, sealing the two spaces from each other.

3. A reciprocating piston positive displacement machine according to claim 1, wherein:

the valve is in sealing cooperation with the port so that, depending on the crankshaft angle, the port is from substantially open allowing the free communication of the two spaces, to substantially closed sealing the two spaces from each other, between the valve and the port there is an adequately small clearance enabling wear-free and friction-free operation without spoiling the sealing.

4. A reciprocating piston positive displacement machine according to claim 1, wherein:

the port (11) comprises a wall (14) having a surface of revolution, the valve (10) has a lip (16), the lip (16) of the valve (10) is in sealing cooperation with the surface of revolution of the wall (14) of the port (11).

5. A reciprocating piston positive displacement machine according to claim 1, wherein:

the port has a lip, the valve comprises a wall having a surface of revolution, the lip of the port is in sealing cooperation with the surface of revolution of the wall of the valve.

6. A reciprocating piston positive displacement machine according to claim 1, wherein:

the port comprises a wall having a surface of revolution, the valve comprises a lip having a surface of revolution, the surface of revolution of the wall of the port and the surface of revolution of the lip of the valve sealingly fit to each other.

7. A reciprocating piston positive displacement machine according to claim 1, wherein:

the crankshaft and the connecting rod are shared with an internal combustion engine.

8. A reciprocating piston positive displacement machine according to claim 1, wherein:

the crankshaft and the connecting rod are shared with a pulling rod internal combustion engine.

* * * * *